US008379062B2

(12) United States Patent
Kubota

(10) Patent No.: US 8,379,062 B2
(45) Date of Patent: Feb. 19, 2013

(54) ELECTRO-OPTICAL DEVICE AND ELECTRONIC APPARATUS

(75) Inventor: Takehiko Kubota, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 932 days.

(21) Appl. No.: 12/476,752

(22) Filed: Jun. 2, 2009

(65) Prior Publication Data

US 2010/0007681 A1 Jan. 14, 2010

(30) Foreign Application Priority Data

Jul. 9, 2008 (JP) ..... 2008-178722

(51) Int. Cl.
*G09G 5/10* (2006.01)

(52) U.S. Cl. ..... 345/690; 345/92; 345/55

(58) Field of Classification Search ..... 345/690, 345/92, 55

See application file for complete search history.

(56) References Cited

U.S. PATENT DOCUMENTS

| | | | | |
|---|---|---|---|---|
| 2004/0113151 | A1* | 6/2004 | Sekine | 257/72 |
| 2007/0159432 | A1* | 7/2007 | Tseng et al. | 345/92 |
| 2010/0073267 | A1* | 3/2010 | Akimoto et al. | 345/76 |

FOREIGN PATENT DOCUMENTS

| | | |
|---|---|---|
| JP | A-2006-30635 | 2/2006 |

* cited by examiner

*Primary Examiner* — William Boddie
*Assistant Examiner* — Leonid Shapiro
(74) *Attorney, Agent, or Firm* — Oliff & Berridge, PLC

(57) ABSTRACT

An electro-optical device includes: a plurality of pixel circuits, each of which is disposed at a position corresponding to each intersection position between a plurality of scanning lines and signal lines; and an initialization line which supplies an initialization potential to the plurality of pixel circuits, wherein each of the plurality of pixel circuits includes: an electro-optical element which has a gray scale in accordance with a current amount of a driving current; a storage capacitor of which a voltage across opposite ends is set in accordance with a potential of the signal line; an initializer which initializes the voltage across opposite ends of the storage capacitor by electrically connecting the initialization line to the storage capacitor; a driving transistor which controls the current amount of the driving current in accordance with the voltage of the storage capacitor; a first conductor which is electrically connected to a gate of the driving transistor and overlaps with the initialization line; and a second conductor which is interposed between the first conductor and the initialization line.

6 Claims, 11 Drawing Sheets

ELECTRO-OPTICAL DEVICE AND ELECTRONIC APPARATUS

BACKGROUND

1. Technical Field

The present invention relates to a structure for driving an electro-optical element.

2. Related Art

In the past, an electro-optical device using an electro-optical element such as an organic EL (Electroluminescence) element has been proposed. For example, a pixel circuit disclosed in JP-A-2006-30635 includes a storage capacitor which holds a voltage in accordance with an externally set gray scale, a driving transistor which generates a driving current in accordance with the voltage of the storage capacitor, and an electro-optical element which has a gray scale in accordance with a current amount of the driving current. The voltage across opposite ends of the storage capacitor is initialized by electrically connecting an initialization line to an electrode, where an initialization potential is supplied to the initialization line.

When the respective parts of the pixel circuit are arranged while overlapping with each other, a decrease in size (an increase in precision) of the pixel circuit is realized compared with a configuration in which the respective parts of the pixel circuit do not overlap with each other. From this viewpoint, for example, a configuration in which the initialization line is disposed while overlapping with a conductor (hereinafter, referred to as "gate conductor") such as a wiring or an electrode electrically connected to a gate of the driving transistor may be supposed. However, since a capacitor is provided between the initialization line and the gate conductor facing each other, a variation in a potential of the gate conductor may occur with a variation in a potential of the initialization line when a current flows during the initialization of the storage capacitor. Since a current amount of the driving current is controlled in accordance with a potential of the gate of the driving transistor, a problem arises in that an error occurs in a gray scale of the electro-optical element due to a variation in a potential of the initialization line. On the other hand, in a configuration in which the initialization line does not overlap with the gate conductor, a problem arises in that an increase in precision of the pixel circuit is limited.

SUMMARY

An advantage of some aspects of the invention is that it provides an electro-optical device capable of obtaining a highly precise pixel circuit by suppressing a variation in a potential of a gate of a driving transistor with a variation in a potential of an initialization line.

According to an aspect of the invention, there is provided an electro-optical device including: a plurality of pixel circuits, each of which is disposed at a position corresponding to each intersection position between a plurality of scanning lines and signal lines; and an initialization line which supplies an initialization potential to the plurality of pixel circuits, wherein each of the plurality of pixel circuits includes: an electro-optical element which has a gray scale in accordance with a current amount of a driving current; a storage capacitor (for example, storage capacitors C0 to C2 shown in FIG. 2 or a storage capacitor C2 shown in FIG. 13) of which a voltage across opposite ends is set in accordance with a potential of the signal line; an initializer (for example, transistors TR1 to TR3 shown in FIG. 2 or a transistor TR4 shown in FIG. 13) which initializes the voltage across opposite ends of the storage capacitor by electrically connecting the initialization line to the storage capacitor; a driving transistor which controls the current amount of the driving current in accordance with the voltage of the storage capacitor; a first conductor which is electrically connected to a gate of the driving transistor and overlaps with the initialization line; and a second conductor which is interposed between the first conductor and the initialization line. With the above-described configuration, since the first conductor overlaps with the initialization line, a decrease in size (an increase in precision) of the pixel circuit is realized compared with the configuration in which the first conductor does not overlap with the initialization line. In addition, since the second conductor is interposed between the first conductor and the initialization line, it is possible to reduce an influence in which a variation in an initialization potential of the initialization line affects a potential (a potential of the gate of the driving transistor) of the first conductor.

The driving transistor may include a semiconductor layer, a gate electrode which faces the semiconductor layer with a gate insulating layer interposed therebetween, and an interconnection layer which is formed on a surface of an insulating layer covering the gate electrode so as to be electrically connected to the semiconductor layer; the initialization line may be formed of the same layer as that of the interconnection layer; the first conductor may be formed of the same layer as that of the semiconductor layer; and the second conductor may be formed of the same layer as that of the gate electrode. With the above-described configuration, since the initialization line or the first and second conductors are formed of the same layer as those of the respective parts of the driving transistor, it is possible to simply form the pixel circuit compared with the case where the initialization line or the first and second conductors are formed by a process separate from a process of forming the driving transistor.

The second conductor may include a power feeding line which supplies a driving current to the electro-optical element. Since a variation in a potential of the power feeding line hardly occurs, it is possible to effectively suppress an influence in which a variation in the initialization potential of the initialization line affects a potential (a potential of the gate of the driving transistor) of the first conductor. In addition, in the configuration in which the storage capacitor includes a first electrode (for example, an electrode e0A shown in FIG. 8) to which a gray-scale potential is supplied from the signal line and a second electrode (for example, an electrode e0B shown in FIG. 8) which is connected to the gate of the driving transistor, the second conductor may include a portion (for example, an electrode e0C shown in FIG. 8) which is electrically connected to the first electrode (for example, a second embodiment described below).

The second conductor may overlap with the initialization line at a portion (for example, a branch portion 55 shown in FIG. 11 or 12) except for a portion overlapping with the first conductor. With the above-described configuration, since the initialization line is provided with the capacitor formed by the second conductor and the initialization line, it is advantageous in that a variation in the initialization potential of the initialization line can be suppressed.

According to another aspect of the invention, there is provided an electronic apparatus including the electro-optical device according to the aspect of the invention. A typical example of the electronic apparatus includes an apparatus which uses an electro-optical device as a display device. As the electronic apparatus according to the invention, a personal computer or a cellular phone is exemplified. Moreover, the application of the electro-optical device according to the invention is not limited to the application of the display of the image. For example, the electro-optical device may be applied to an exposure device (exposure head) used to form a latent image on an image carrier such as a photosensitive drum by means of irradiation of a beam.

BRIEF DESCRIPTION OF THE DRAWINGS

The invention will be described with reference to the accompanying drawings, wherein like numbers reference like elements.

DESCRIPTION OF EXEMPLARY EMBODIMENTS

A: First Embodiment

Figure 1:
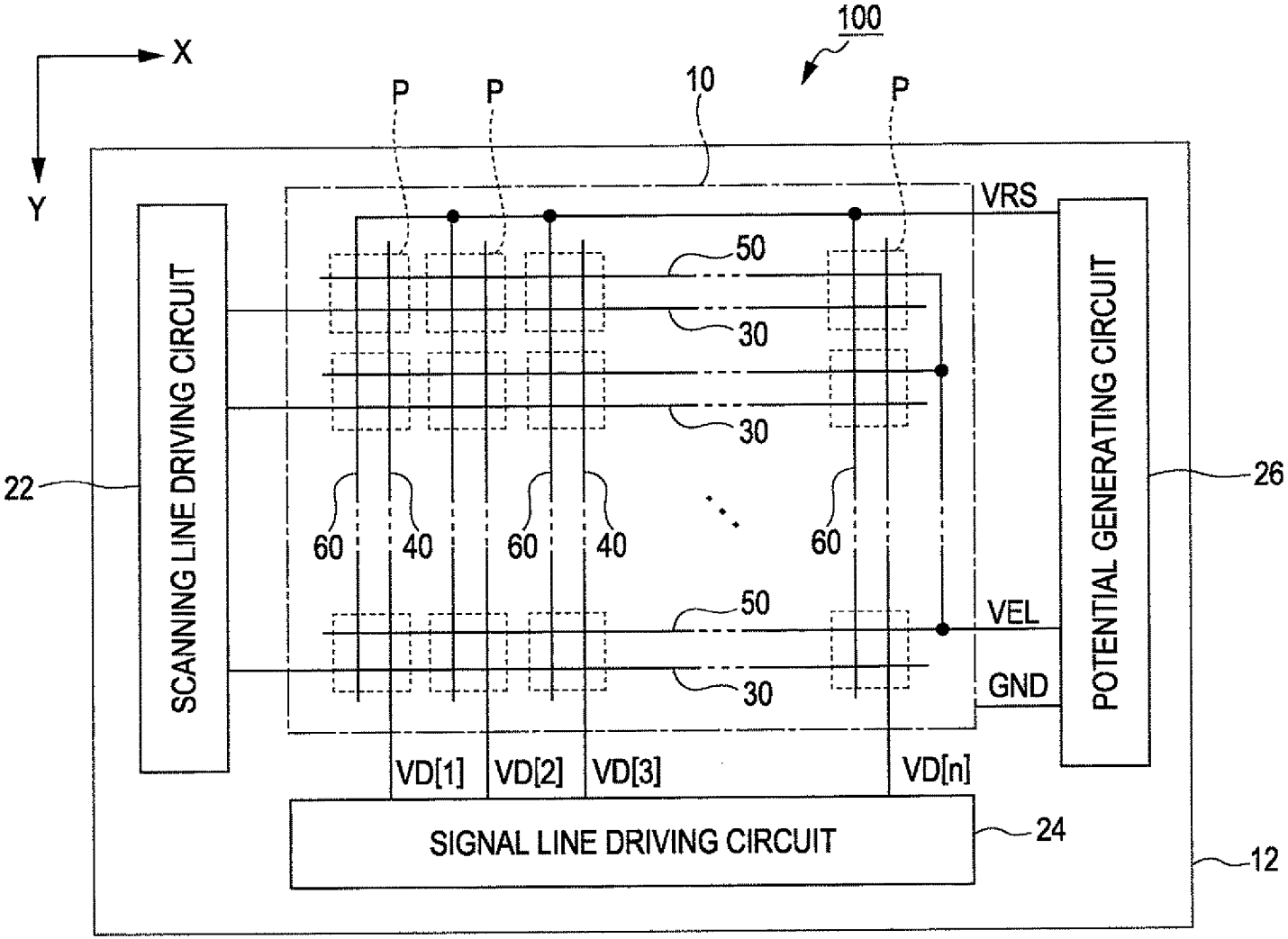
FIG. 1 is a block diagram showing an electro-optical device according to a first embodiment of the invention.

FIG. 1 is a block diagram showing an electro-optical device according to a first embodiment of the invention. An electro-optical device 100 serves as a display device which is mounted to an electronic apparatus so as to display an image thereon. As shown in FIG. 1, the electro-optical device 100 includes an element unit 10 which has a plurality of pixel circuits P arranged in a plane shape; a scanning line driving circuit 22 and a signal line driving circuit 24 which drive each pixel circuit P; and a potential generating circuit 26 which generates a potential used in the electro-optical device 100. In addition, a part or an entire part of the scanning line driving circuit 22, the signal line driving circuit 24, and the potential generating circuit 26 may be provided in a single circuit. Alternatively, the scanning line driving circuit 22 or the signal line driving circuit 24 may be separately mounted to a plurality of integrated circuits.

The element unit 10 shown in FIG. 1 is disposed on a substrate 12. The element unit 10 has m pairs of control line groups 30 which extends in an X direction and n number of signal lines 40 which extend in a Y direction intersecting (perpendicular to) the X direction (where m and n are natural numbers). Each of the plurality of pixel circuits P is disposed at an intersection position of each control line group 30 and each signal line 40 so as to have a matrix shape of "m rows×n columns". In addition, the element unit 10 has m number of power feeding lines 50 which extend in the X direction together with the control line groups 30 and n number of initialization lines 60 which extend in the Y direction together with the signal lines 40.

The scanning line driving circuit 22 sequentially selects the plurality of pixel circuits P by the unit of row. The signal line driving circuit 24 outputs n channels of gray-scale potentials VDs (VD[1] to VD[n]) in parallel to the signal lines 40 in synchronization with the selection of the scanning line driving circuit 22. The gray-scale potential Vd[j] which is output to the signal line 40 at a j-th column (where j=1 to n) upon selecting an i-th row (where i=1 to m) is set to a potential corresponding to a gray-scale value designated by the pixel circuit P at the j-th column included in the i-th row.

The potential generating circuit 26 generates a high level potential VEL, a low level potential GND, and an initialization potential VRS set to a predetermined value. The potential VEL is output to the m number of power feeding lines 50 so as to be commonly supplied to the pixel circuits P. The initialization potential VRS is output to the n number of initialization lines 60 so as to be commonly supplied to the pixel circuits P. In addition, a circuit for generating the potential VEL or the potential GND may be provided separately from a circuit for generating the initialization potential VRS.

Figure 2:
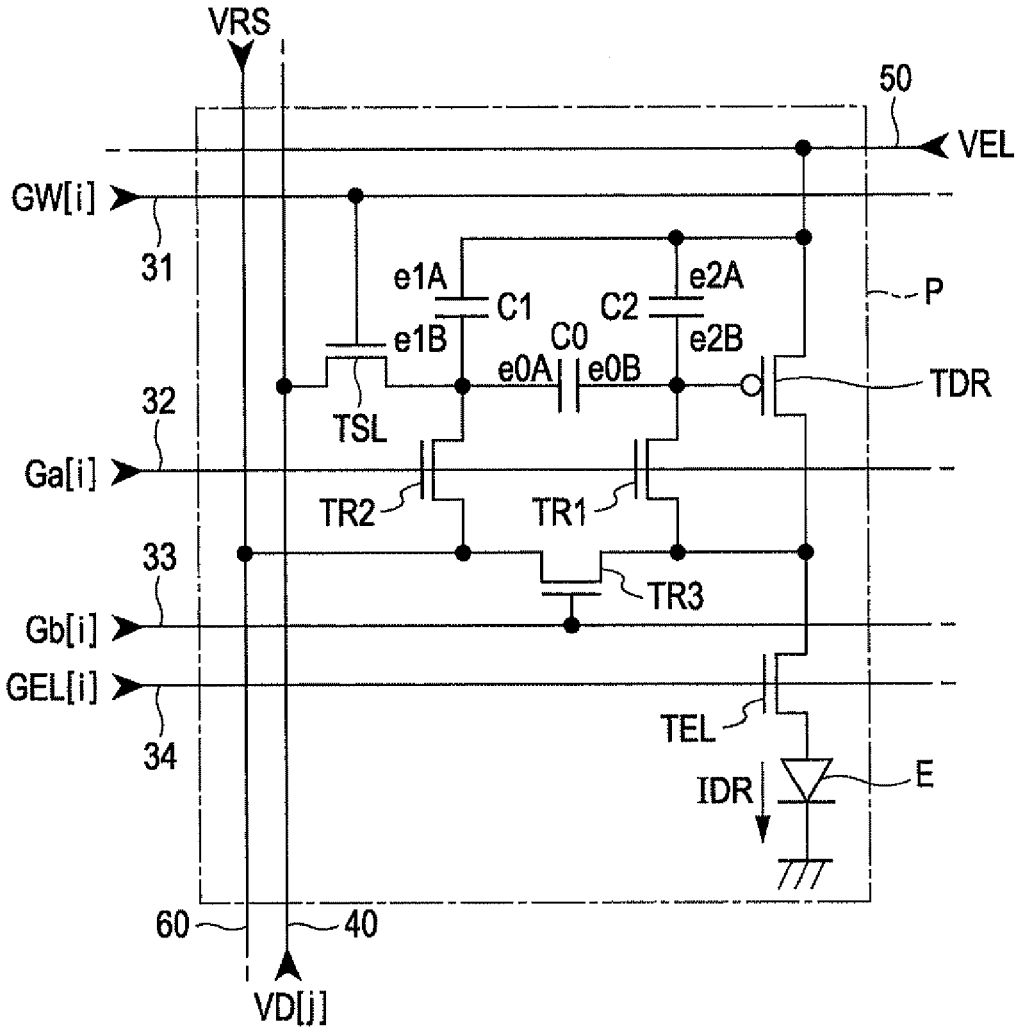
FIG. 2 is a circuit diagram showing a pixel circuit.

FIG. 2 is a circuit diagram showing the pixel circuit P. In FIG. 2, only one pixel circuit P at the j-th column included in the i-th row is representatively shown. As shown in FIG. 2, the pixel circuit P includes an electro-optical element E which is disposed on a path used to connect the power feeding line 50 for receiving the potential VEL and a ground line for receiving the potential GND to each other. The electro-optical element E is a current-driving type light emitting element which has a gray scale in accordance with a current amount of a driving current IDR flowing from the power feeding line 50 to the ground line. For example, as the electro-optical element E, an organic EL element having a configuration in which a light emitting layer formed of an organic EL material is interposed between a cathode and an anode facing each other may be desirably used.

As shown in FIG. 2, one pair of the control line groups 30 shown in FIG. 1 is formed by four wiring lines (a scanning line 31, a first control line 32, a second control line 33, and a light emitting control line 34). The scanning line driving circuit 22 supplies a signal to the wiring lines of the control line groups 30. For example, a scanning signal GW[i] for selecting the i-th row is supplied to the scanning line 31. In addition, a first control signal Ga[i] is supplied to the first control line 32, and a second control signal Gb[i] is supplied to the second control line 33. A light emitting control signal GEL[i] is supplied to the light emitting control line 34.

A P-channel-type driving transistor TDR and an N-channel-type light emitting control transistor TEL are disposed on a path of a driving current IDR. In the driving transistor TDR, the drain of the driving transistor TDR is connected to the drain of the light emitting control transistor TEL at the same time when the source of the driving transistor TDR is connected to the power feeding line 50, thereby controlling a current amount of the driving current IDR in accordance with a potential (hereinafter, referred to as "gate potential VG") of the gate of the driving transistor TDR. In the light emitting control transistor TEL, the source of the light emitting control transistor TEL is connected to the electro-optical element E (cathode) at the same time when the gate of the light emitting control transistor TEL is connected to the light emitting control line 34, thereby controlling whether the driving current IDR is supplied to the electro-optical element E. In addition, a configuration in which the driving transistor TDR or the light emitting control transistor TEL is disposed between the electro-optical element E and the ground line may be adopted.

A storage capacitor C0 shown in FIG. 2 holds a voltage between electrodes e0A and e0B. The electrode e0B is connected to the gate of the driving transistor TDR. An N-channel-type selection transistor TSL is interposed between the signal line 40 and the electrode e0A of the storage capacitor C0 so as to control an electric connection (a state where both are electrically connected or not electrically connected to each other) therebetween. The gate of the selection transistor TSL is connected to the scanning line 31. In addition, a storage capacitor C1 holds a potential of the electrode e0A, and a storage capacitor C2 holds a potential (the gate potential VG) of the electrode e0B. The storage capacitor C1 includes an electrode e1A connected to the power feeding line 50 and an electrode e1B connected to the electrode e0A. The storage capacitor C2 includes an electrode e2A connected to the power feeding line 50 and an electrode e2B connected to the electrode e0B.

An N-channel-type transistor TR1 is interposed between the gate and the drain of the driving transistor TDR. An N-channel-type transistor TR2 is interposed between the initialization line 60 and the electrode e0A of the storage capacitor C0. The gates of the transistors TR1 and TR2 are connected to the first control line 32. In addition, an N-channel-type transistor TR3 is interposed between the transistors TR1 and TR2. The gate of the transistor TR3 is connected to the second control line 33.

Figure 3:
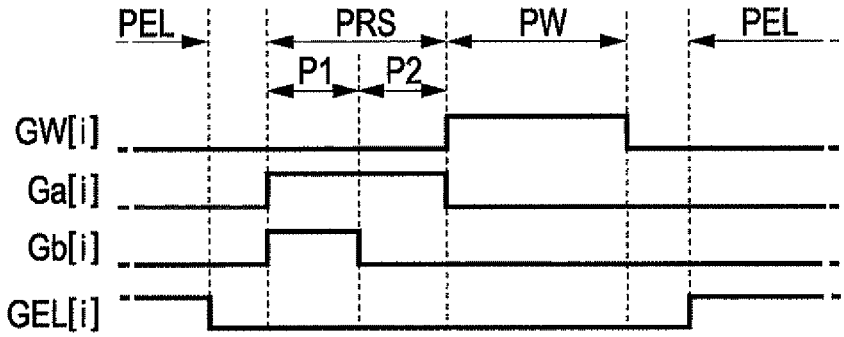
FIG. 3 is a timing chart showing an operation of the electro-optical device.

FIG. 3 is a timing chart showing an operation of the electro-optical device 100. As shown in FIG. 3, scanning signals GW[1] to GW[m] are sequentially set to a high level (a level meaning the selection of the i-th row) for each writing period (a horizontal scanning period) PW. The first control signal Ga[i] becomes a high level during the initialization period PRS before the start of the writing period PW at which the scanning signal GW[i] becomes a high level. The first control signal Ga[i] is maintained to be a low level during a period except for the initialization period PRS. The initialization period PRS is divided into periods P1 and P2. The period P1 indicates a period at which a voltage across opposite ends of the storage capacitor C0 is initialized to be a predetermined value. The period P2 after the period P1 indicates a period at which the gate potential VG of the driving transistor TDR is set to a potential in accordance with the threshold voltage VTH of the driving transistor TDR.

The second control signal Gb[i] is set to a high level during the period P1, and is set to a low level during a period except for the period P1. The light emitting control signal GEL[i] becomes a high level during a light emitting period PEL before the start of the initialization period PRS at which the first control signal Ga[i] becomes a high level after the writing period PW at which the scanning signal GW[i] becomes a high level. The light emitting control signal GEL[i] is maintained to be a low level during a period except for the light emitting period PEL. Hereinafter, an operation of the pixel circuit P will be described with reference to the initialization period PRS, the writing period PW, and the light emitting period PEL.

Since the first control signal Ga[i] and the second control signal Gb[i] are set to a high level during the period P1 of the initialization period PRS, the transistors TR1, TR2, and TR3 become an on state. Accordingly, the electrodes e0A and e0B of the storage capacitor C0 are electrically connected to each other, and an initialization potential VRS is supplied from the initialization line 60 to both electrodes e0A and e0B. Since the electrodes e0A and e0B are electrically connected to each other, an electric charge accumulated in the storage capacitor C0 is discharged at the time of the start of the initialization period PRS.

Since only the first control signal Ga[i] is set to a high level during the period P2 of the initialization period PRS, the transistors TR1 and TR2 are maintained to be an on state (the transistor TR3 becomes an off state). Accordingly, from the period P1, the initialization potential VRS is continuously supplied from the initialization line 60 to the electrode e0A of the storage capacitor C0 via the transistor TR2. In addition, since the gate and the drain of the driving transistor TDR are diode-connected to each other via the transistor TR1, a potential of the gate (the electrode e0B of the storage capacitor C0) of the driving transistor TDR increases more than the potential VEL of the power feeding line 50 so as to be lower than the threshold voltage VTH. As described above, the voltage across opposite ends of the storage capacitor C0 is initialized to be a predetermined value (|VEL-VTH-VRS|) during the initialization period PRS. In the same manner, the voltages of the storage capacitors C1 and C2 are initialized to be a predetermined value.

Since the selection transistor TSL becomes an on state by setting the scanning signal GW[i] to a high level during the writing period PW, a potential of the electrode e0A of the storage capacitor C0 changes from the initialization potential VRS set during the initialization period PRS to the gray-scale potential VD[j] of the signal line 40. Since the gate of the driving transistor TDR is in an electric floating state due to the transistor TR1 changing to an off state during the writing period PW, a potential of the gate (the electrode e0B) of the driving transistor TDR changes from a potential (VEL-VTH) set during the initialization period PRS in accordance with a change amount (VRS→VD[j]) of a potential of the electrode e0A. That is, the gate potential VG of the driving transistor TDR is set to a potential in accordance with the gray-scale potential VD[j] and the threshold voltage VTH of the driving transistor TDR.

Since the light emitting control signal GEL[i] becomes a high level during the light emitting period PEL, the light emitting control transistor TEL becomes an on state. Accordingly, the driving current IDR having a current amount in accordance with the gate potential VG of the driving transistor TDR is supplied from the power feeding line 50 to the electro-optical element E via the driving transistor TDR and the light emitting control transistor TEL. The electro-optical element E is controlled by the gray scale (the gray scale in accordance with the gray-scale potential VD[j]) in accordance with the current amount of the driving current IDR. Since the threshold voltage VTH of the driving transistor TDR is reflected in the gate potential VG of the driving transistor TDR during the light emitting period PEL, a blur of the gray scale of the electro-optical element E caused by a difference in the threshold voltages VTH of the driving transistors TDR is compensated.

Figure 4:
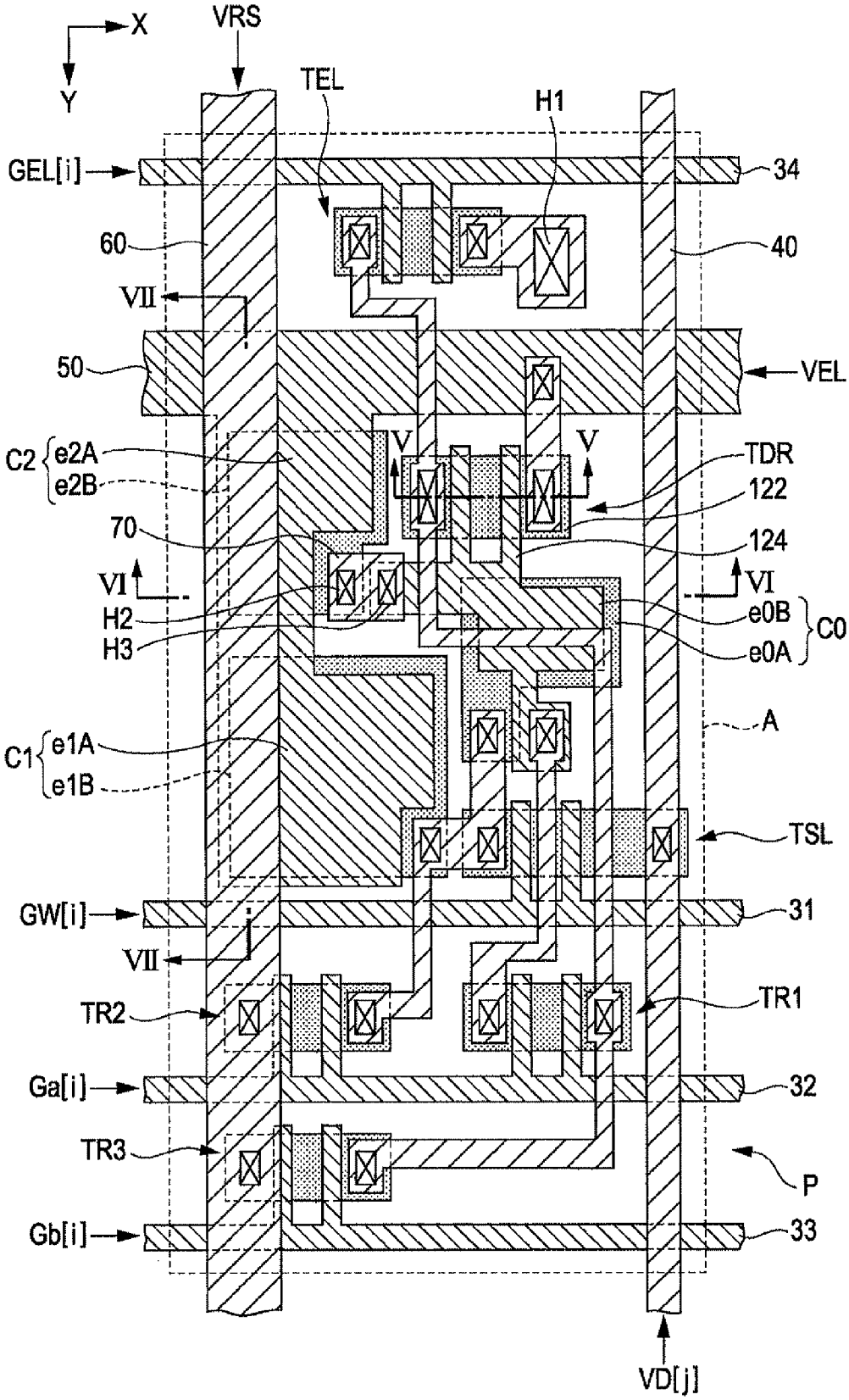
FIG. 4 is a top view showing a pixel circuit P.

Next, a structure of the pixel circuit P described above will be described. FIG. 4 is a top view showing one pixel circuit P. As shown in FIG. 4, the pixel circuit P is formed in a rectangular unit area A defined on a surface of a substrate 12. In the unit area A, the power feeding line 50 and the scanning line 31 extend in the X direction, and the signal line 40 and the initialization line 60 extend in the Y direction. The driving transistor TDR is disposed in an area surrounded by the power feeding line 50, the scanning line 31, the signal line 40, and the initialization line 60.

The selection transistor TSL is disposed between the driving transistor TDR and the scanning line 31. The light emitting control line 34 extends in the X direction in an area which is located on the opposite side of the driving transistor TDR with the power feeding line 50 interposed therebetween. The light emitting control transistor TEL is disposed between the power feeding line 50 and the light emitting control line 34. In addition, the first control line 32 is formed in an area which is located on the opposite side of the driving transistor TDR with the scanning line 31 interposed therebetween. The second control line 33 is formed in an area which is located on the opposite side of the scanning line 31 with the first control line 32 interposed therebetween. The transistors TR1 and TR2 are disposed between the scanning line 31 and the first control line 32. The transistor TR3 is disposed between the first control line 32 and the second control line 33.

Figure 5:
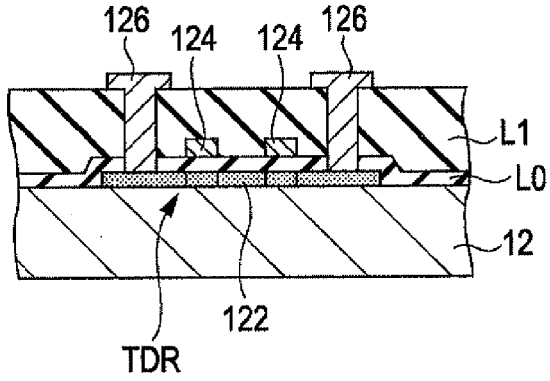
FIG. 5 is a sectional view taken along the line V-V in FIG. 4.

FIG. 5 is a sectional view taken along the line V-V in FIG. 4. The driving transistor TDR includes a semiconductor layer 122 which is formed on the substrate 12 by means of a semiconductor material (for example, polysilicon) and gate electrodes 124 which are opposed to a channel area of the semiconductor layer 122. A gate insulating layer L0 is interposed between the semiconductor layer 122 and the gate electrodes 124 so as to be continuously formed in the entire area of the substrate 12. An insulating layer L1 is disposed on the gate insulating layer L0 provided with the gate electrodes 124 so as to be continuously formed in the entire area of the substrate 12. Interconnection layers 126 (a source electrode and a drain electrode) formed on the insulating layer L1 are electrically connected to the semiconductor layer 122 via a connection hole.

The transistors T (TR1, TR2, TR3, TEL, and TSL) forming the pixel circuit P are formed by a common process of forming the driving transistor TDR. That is, the respective parts of the transistors T and the respective parts of the driving transistor TDR are integrally formed by a common process by selectively removing a single film member (hereinafter, simply described that the respective parts thereof are formed of the same layer). For example, the semiconductor layers of the respective transistors T are formed of the same layer as that of the semiconductor layer 122 of the driving transistor TDR. The gate electrodes of the respective transistors T are formed of the same layer as those of the gate electrodes 124 of the driving transistor TDR. In FIG. 4, the respective conductive members (electrodes or wirings) formed of the same layer are depicted by the common hatching. In addition, the respective transistors forming the pixel circuit P may have a bottom gate structure.

The control line group 30 (the scanning line 31, the first control line 32, the second control line 33, and the light emitting control line 34) and the power feeding line 50 are formed of the same layer as those of the gate electrodes 124 of the driving transistor TDR. In addition, the initialization line 60 and the signal line 40 are formed of the same layer as those of the interconnection layers 126 (the source electrode and the drain electrode) of the driving transistor TDR. The connection relationship between the respective parts of the pixel circuit P has already been described with reference to FIG. 2. The cathode (pixel electrode) of the electro-optical element E is electrically connected to the source electrode of the light emitting control transistor TEL via a connection hole H1 (FIG. 4) of the insulating layer for coating the insulating layer L1.

Figure 6:
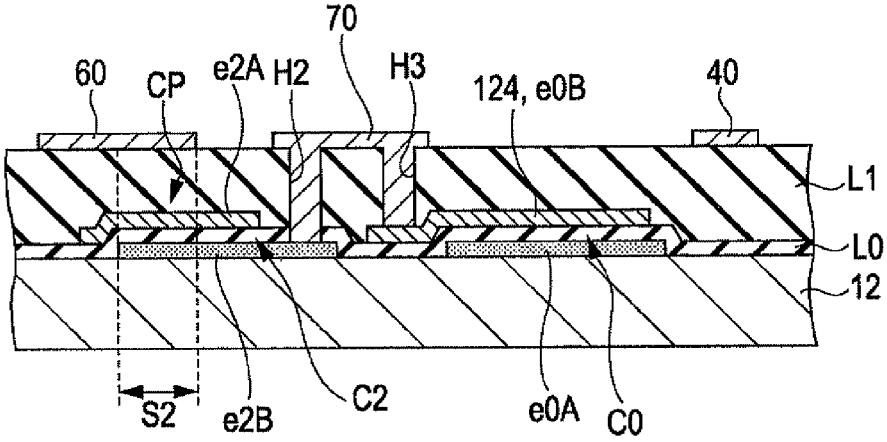
FIG. 6 is a sectional view taken along the line VI-VI in FIG. 4.
Figure 7:
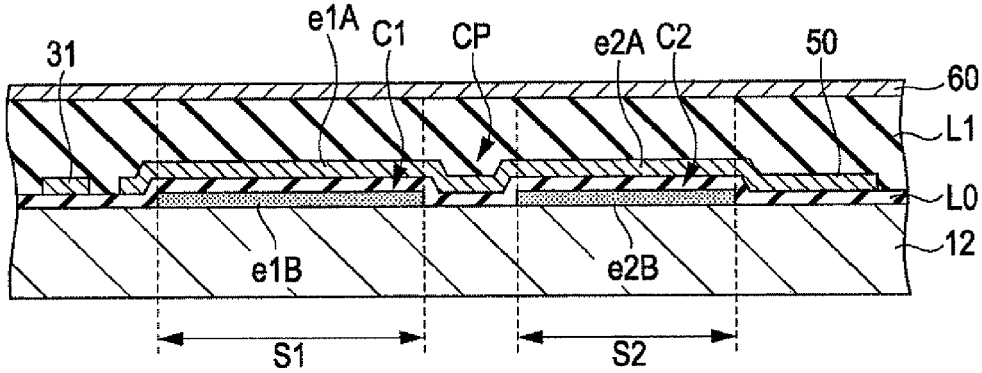
FIG. 7 is a sectional view taken along the line VII-VII in FIG. 4.

FIG. 6 is a sectional view taken along the line VI-VI in FIG. 4. FIG. 7 is a sectional view taken along the line VII-VII in FIG. 4. As shown in FIGS. 6 and 7, the electrode e0A of the storage capacitor C0, the electrode e1B of the storage capacitor C1, and the electrode e2B of the storage capacitor C2 are formed of the same layer as that of the semiconductor layer 122 of the driving transistor TDR. Meanwhile, the electrode e0B of the storage capacitor C0, the electrode e1A of the storage capacitor C1, and the electrode e2A of the storage capacitor C2 are formed of the same layer as those of the gate electrodes 124 of the driving transistor TDR. As shown in FIG. 4, the electrode e1A of the storage capacitor C1 and the electrode e2A of the storage capacitor C2 are continuous to the power feeding line 50.

The electrode e2B of the storage capacitor C2 is electrically connected to the gate electrode 124 (the electrode e0B of the storage capacitor C0) of the driving transistor TDR via a wiring 70 which is formed of the same layer as those of the interconnection layers 126. That is, as shown in FIG. 6, the wiring 70 is electrically connected to the electrode e2B of the storage capacitor C2 via a connection hole H2 penetrating the insulating layer L1 and the gate insulating layer L0. Also, the wiring 70 is electrically connected to the gate electrode 124 via a connection hole H3 penetrating the insulating layer L1.

As shown in FIGS. 6 and 7, the electrode e2B of the storage capacitor C2 includes an area S2 overlapping with the initialization line 60 when viewed in a direction perpendicular to the substrate 12. The electrode e2A (the power feeding line 50) of the storage capacitor C2 is interposed between the electrode e2B and the initialization line 60. As shown in FIGS. 6 and 7, the electrode e2A is formed so as to overlap with the entire area S2 (an area where the electrode e2B overlaps with the initialization line 60) of the electrode e2B. In the same manner, as shown in FIG. 7, the electrode e1B of the storage capacitor C1 includes an area S1 overlapping with the initialization line 60 when viewed in a direction perpendicular to the substrate 12. The electrode e1A (the power feeding line 50) of the storage capacitor C1 is interposed between the electrode e1B and the initialization line 60 so as to overlap with the entire area S1 of the electrode e1B.

In the above-described embodiment, since the initialization line 60 is formed so as to partly overlap with the storage capacitor C1 (the electrodes e1A and e1B) and the storage capacitor C2 (the electrodes e2A and e2B) when viewed in a direction perpendicular to the substrate 12, it is possible to reduce an area of the pixel circuit P (unit area A) compared with the configuration in which the initialization line 60 does not overlap with the storage capacitors C1 and C2. Accordingly, it is advantageous in that an image is displayed on the element unit 10 with high precision.

Further, in this embodiment, as shown in FIGS. 6 and 7, the electrode e2A (the power feeding line 50) is interposed between the initialization line 60 and the electrode e2B electrically connected to the gate electrode 124 of the driving transistor TDR. Accordingly, even when a variation in the initialization potential VRS occurs when the initialization line 60 is connected to the storage capacitor C0 (a current flows through the initialization line 60) during the initialization period PRS, it is possible to suppress a variation in a potential (the gate potential VG) of the electrode e2B. That is, the electrode e2A serves as a shield for reducing an influence in which a variation in the initialization potential VRS affects a potential of the electrode e2B.

In the same manner, as shown in FIG. 7, the electrode e1A (the power feeding line 50) interposed between the initialization line 60 and the electrode e1B of the storage capacitor C1 serves as a shield for reducing an influence in which a variation in the initialization potential VRS affects a potential of the electrode e1B. Accordingly, even when a variation in the initialization potential VRS occurs, it is possible to suppress a variation in a potential (or the gate potential VG) of the electrode e1B.

In the above-described embodiment, since the gate potential VG of the driving transistor TDR is highly precisely set, it is advantageous in that an error of the gray scale of the electro-optical element E caused by a variation in the initialization potential VRS is effectively reduced. That is, it is possible to obtain the pixel circuit P having high precision and to accurately control the gate potential VG.

Incidentally, as shown in FIG. 7, since the electrodes e1A and e2A (power feeding line 50) face the initialization line 60 with the insulating layer L1 interposed therebetween, the capacitor CP formed by the initialization line 60 and the electrodes e1A and e2A by using the insulating layer L1 as the dielectric substance is provided between the initialization line 60 and the power feeding line 50. As described above, since the initialization line 60 is provided with the capacitor CP, it is possible to suppress a variation in the initialization potential VRS. In the same manner, since the power feeding line 50 is provided with the capacitor CP, it is possible to suppress a variation in the potential VEL occurring when the driving current IDR flows from the power feeding line 50 to the electro-optical element E. That is, the capacitor CP serves as an element for smoothing a variation in the potentials of the initialization line 60 and the power feeding line 50.

B: Second Embodiment

Next, a second embodiment of the invention will be described. In addition, in the respective embodiments described below, the same reference numerals will be given to the same parts as those of the first embodiment, and the detailed description thereof will be appropriately omitted.

Figure 8:
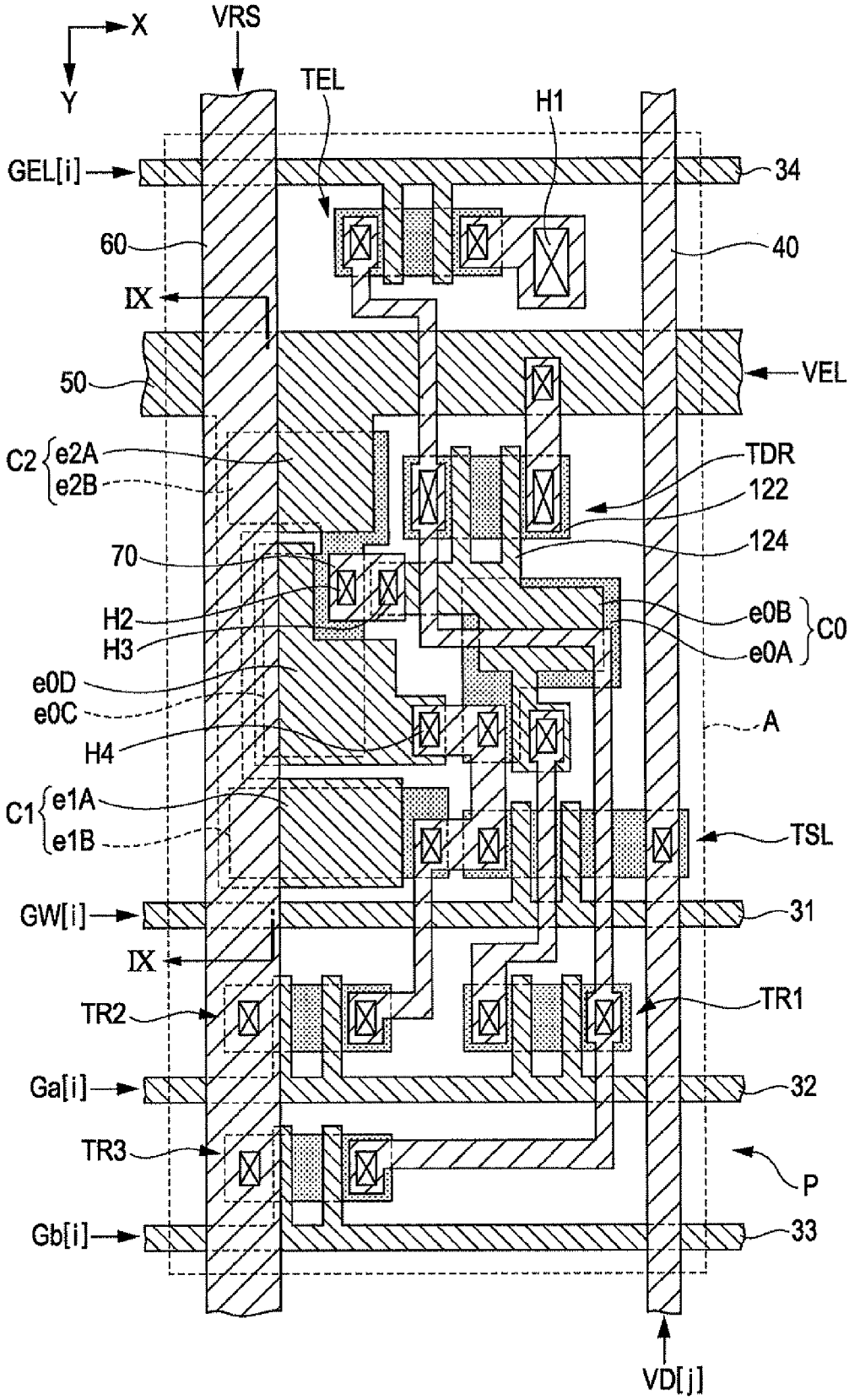
FIG. 8 is a top view showing the pixel circuit according to a second embodiment of the invention.
Figure 9:
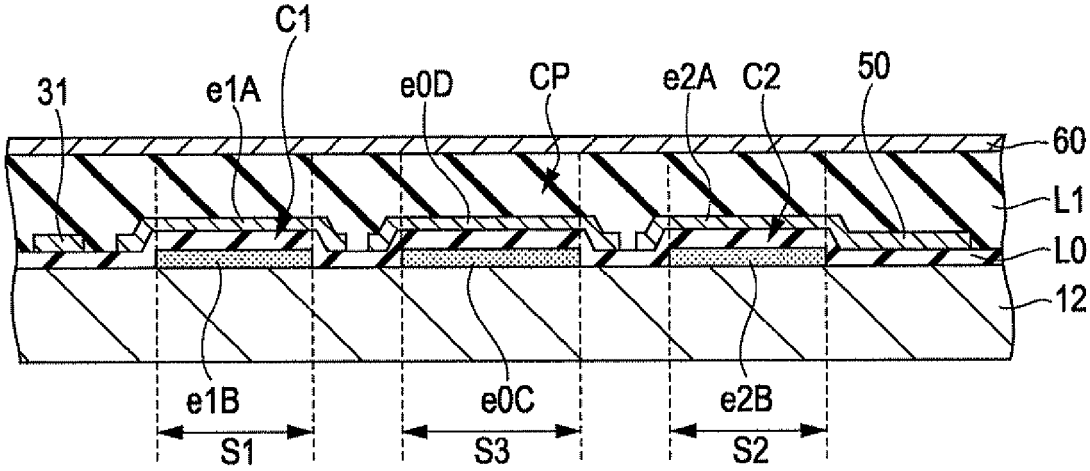
FIG. 9 is a sectional view taken along the line IX-IX in FIG. 8.

FIG. 8 is a top view showing the pixel circuit P according to this embodiment. FIG. 9 is a sectional view taken along the line IX-IX in FIG. 8. As shown in FIGS. 8 and 9, there are shown a configuration in which the electrode e1A is interposed between the initialization line 60 and the electrode e1D of the storage capacitor C1 and a configuration in which the electrode e2A is interposed between the initialization line 60 and the electrode e2B of the storage capacitor C2. These configurations are the same as that of the first embodiment.

Figure 10:
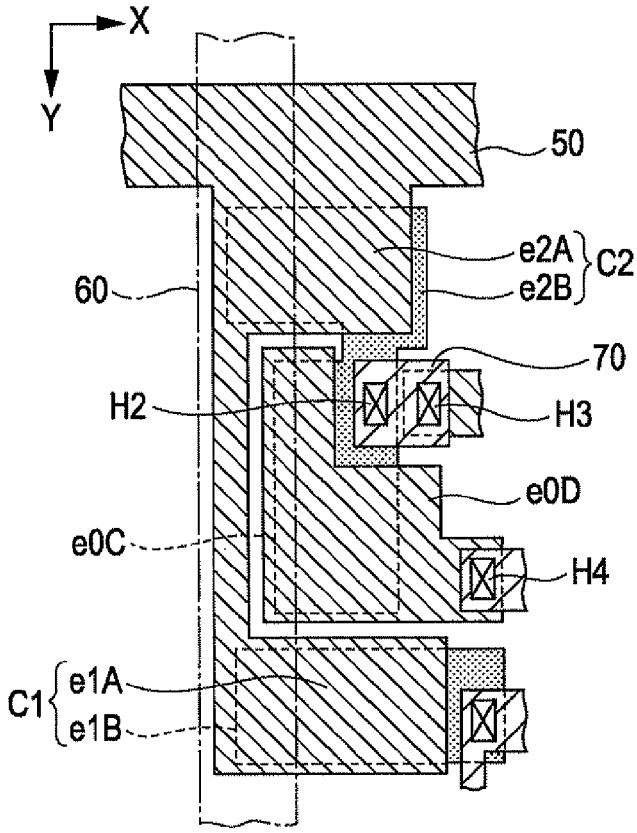
FIG. 10 is a top view showing a portion in the vicinity of a storage capacitor.

FIG. 10 is a top view showing a portion in the vicinity of the storage capacitor C1 or C2. In FIG. 10, the outline of the initialization line 60 is depicted by the chain line. As shown in FIGS. 8 and 10, in the unit area A, an area in a gap between the storage capacitors C1 and C2 is provided with electrodes e0C and e0D. The electrode e0C is a portion which is continuous to the electrode e2B of the storage capacitor C2 (whereby the electrode e0C is formed of the same layer as that of the semiconductor layer 122). The electrode e0C is electrically connected to the gate electrode 124 of the driving transistor TDR via the wiring 70 together with the electrode e2B. On the other hand, the electrode e0D is formed of the same layer as that of the gate electrode 124 of the driving transistor TDR, and is electrically connected to the electrode e0A via a connection hole H4. In the above-described configuration, the electrodes e0B and e0C form an electrode on the side of the driving transistor TDR in the storage capacitor C0. The electrodes e0A and e0D form an electrode on the side of the selection transistor TSL of the storage capacitor C0. Accordingly, it is advantageous in that a capacitance value sufficient for the storage capacitor C0 is ensured compared with the first embodiment.

As shown in FIG. 9, an area S3 of the electrode e0C overlaps with the initialization line 60 when viewed in a direction perpendicular to the substrate 12. The electrode e0D is interposed between the electrode e0C and the initialization line 60. As shown in FIG. 9 or 10, the electrode e0D is formed so as to overlap with the entire area S3 (an area where the electrode e0C overlaps with the initialization line 60) of the electrode e0C. Accordingly, in the same manner as the storage capacitor C1 or C2, it is possible to suppress a variation in a potential (the gate potential VG) of the electrode e0C even when a variation in the initialization potential VRS of the initialization line 60 occurs. That is, the electrode e0D serves as a shield for reducing an influence in which a variation in the initialization potential VRS affects a potential of the electrode e0C. In addition, since the initialization line 60 faces the electrode e0D with the insulating layer L1 interposed therebetween so as to form the capacitor CP, it is advantageous in that a variation in the initialization potential VRS is suppressed.

In addition, since the capacitor CP is formed by the initialization line 60 and the electrode e0D as described above, a variation in a potential of the electrode e0D may occur with a variation in the initialization potential VRS. However, a variation amount of the potential of the gate electrode 124 of the driving transistor TDR caused by a variation in a potential of the electrode e0D is nothing but a voltage in which a variation amount of the potential of the electrode e0D is divided in accordance with a capacitance ratio between the storage capacitors C0 and C2. Accordingly, it is possible to reliably suppress a variation in the gate potential VG compared with the case where a variation in the initialization potential VRS directly causes a variation in a potential of the electrode e0C (that is, the case where the electrode e0D is not interposed between the electrode e0C and the initialization line 60).

C: Third Embodiment

Figure 11:
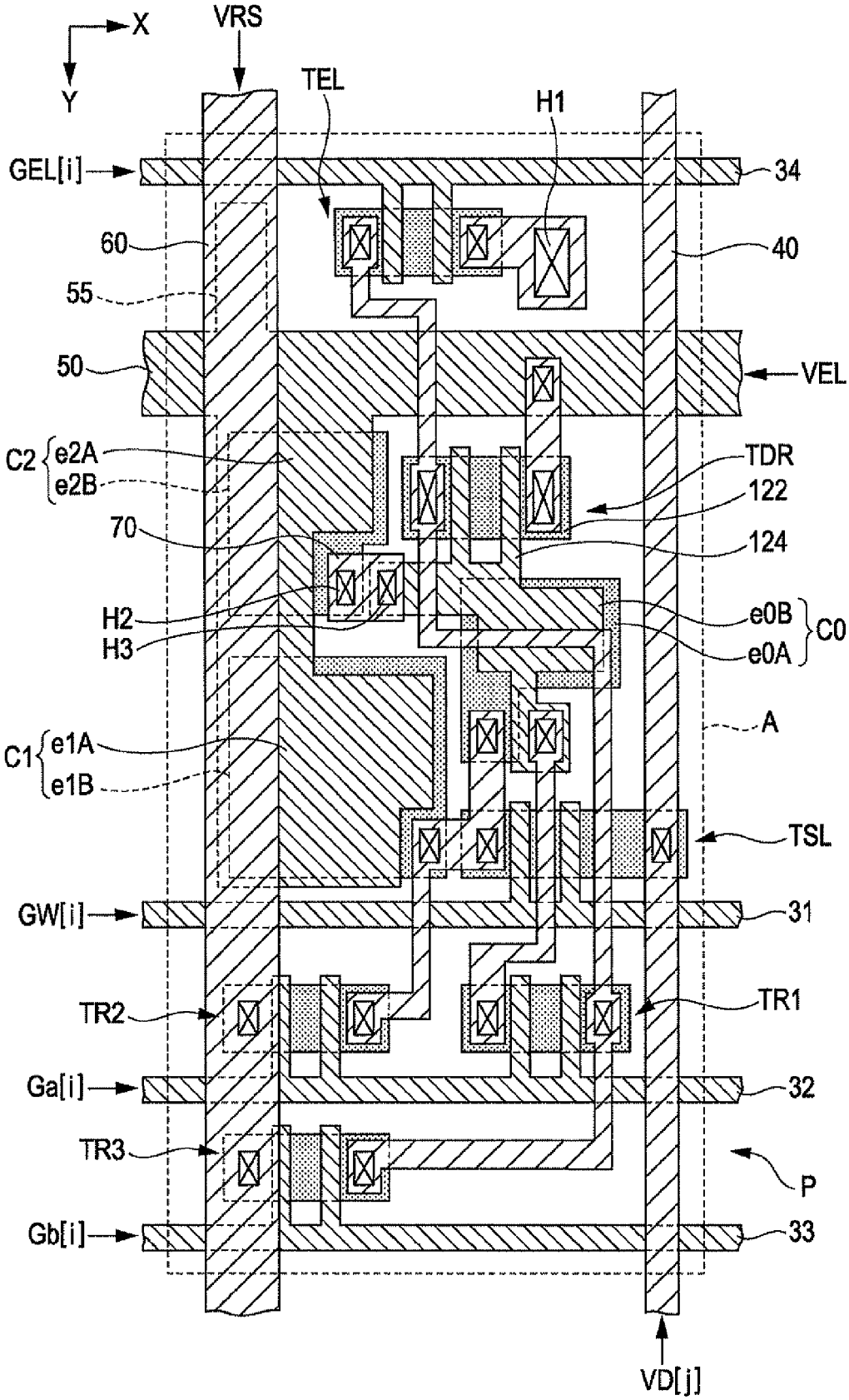
FIG. 11 is a top view showing the pixel circuit according to a third embodiment of the invention.

FIG. 11 is a top view showing the pixel circuit P according to a third embodiment of the invention. As shown in FIG. 11, the power feeding line 50 is provided with a branch portion 55. The branch portion 55 branches from an intersection portion between the power feeding line 50 and the initialization line 60 toward the opposite side of the storage capacitor C1 or C2 so as to extend in the Y direction. In the configuration in FIG. 11, since the branch portion 55 faces the initialization line 60 with the insulating layer L1 interposed therebetween so as to form a capacitor, it is possible to sufficiently ensure the capacitor CP between the initialization line 60 and the power feeding line 50. Accordingly, it is advantageous in that a variation in a potential of the initialization line 60 or the power feeding line 50 is effectively suppressed. Additionally, the configuration in which the power feeding line 50 is provided with the branch portion 55 as shown in FIG. 11 is applied to the second embodiment in the same manner.

D: Fourth Embodiment

Figure 12:
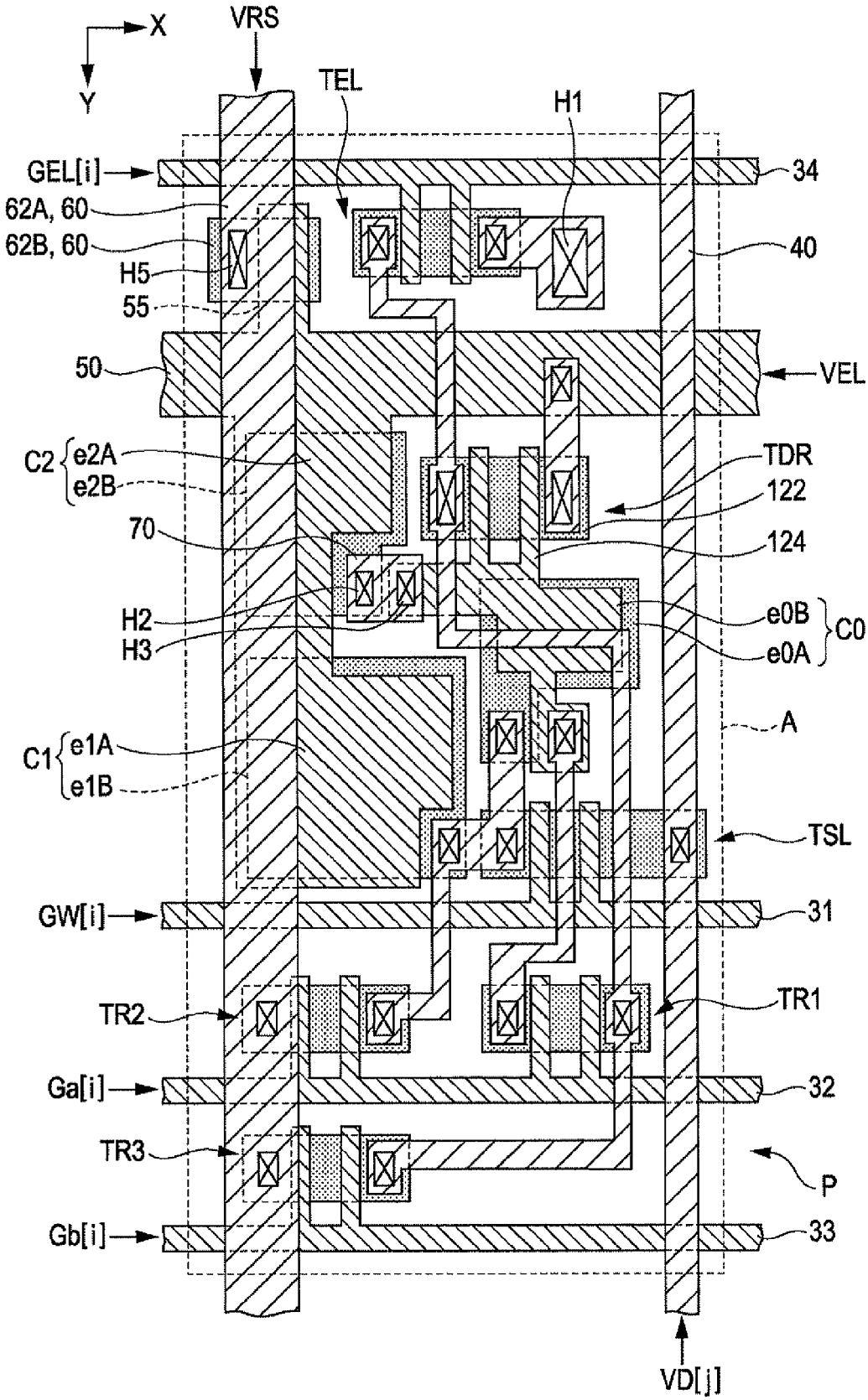
FIG. 12 is a top view showing the pixel circuit according to a fourth embodiment of the invention.

FIG. 12 is a top view showing the pixel circuit P according to a fourth embodiment of the invention. As shown in FIG. 12, the initialization line 60 includes portions 62A and 62B. The portion 62A is a portion which has the same shape as that of the initialization line 60 according to the first to third embodiments. The portion 62B is formed of the same layer as that of the semiconductor layer 122 of the driving transistor TDR. As shown in FIG. 12, the portion 62B overlaps with the portion 62A with the branch portion 55 of the power feeding line 50 interposed therebetween. That is, the branch portion 55 is interposed between the portions 62A and 62B of the initialization line 60. The portion 62A is electrically connected to the portion 62B via a connection hole H5 penetrating the insulating layer L1 and the gate insulating layer L0.

With the above-described configuration, the insulating layer L1 as the dielectric substance is disposed between the branch portion 55 and the portion 62A of the initialization line 60 so as to form a capacitor. In addition, the branch portion 55 and the portion 62B form a capacitor by using the gate insulating layer L0 as the dielectric substance. As described above, since it is possible to sufficiently ensure the capacitor CP between the initialization line 60 and the power feeding line 50, it is possible to effectively suppress a variation in a potential of the initialization line 60 or the power feeding line 50. Particularly, since a film thickness of the gate insulating layer L0 is smaller than that of the insulating layer L1, it is advantageous in that a capacitance value sufficient for the capacitor including the branch portion 55 and the portion 62B is easily ensured.

E: Fifth Embodiment

Figure 13:
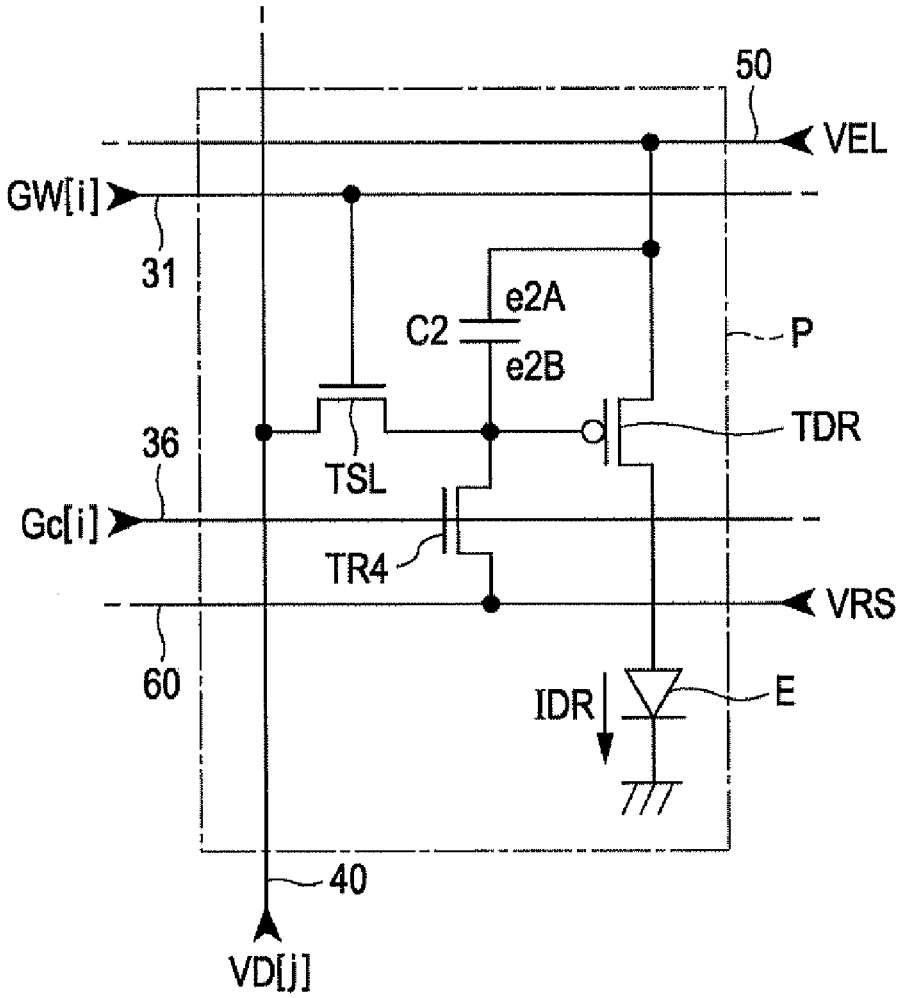
FIG. 13 is a circuit diagram showing the pixel circuit according to a fifth embodiment of the invention.

FIG. 13 is a circuit diagram showing the pixel circuit P of the electro-optical device 100 according to a fifth embodiment of the invention. In the same manner as the first embodiment, the driving transistor TDR is disposed on the path of the driving current IDR supplied from the power feeding line 50 to the electro-optical element E. The storage capacitor C2 is interposed between the power feeding line 50 and the gate of the driving transistor TDR. That is, the electrode e2A of the storage capacitor C2 is connected to the power feeding line 50, and the electrode e2B thereof is connected to the gate of the driving transistor TDR.

The selection transistor TSL is interposed between the signal line 40 and the gate of the driving transistor TDR. The transistor TR4 is interposed between the initialization line 60 and the gate of the driving transistor TDR. As shown in FIG. 13, the pair of control line groups 30 according to this embodiment includes the scanning line 31 to which the scanning signal GW[i] is supplied and the control line 36 to which a control signal Gc[i] is supplied. The gate of the selection transistor TSL is connected to the scanning line 31, and the gate of the transistor TR4 is connected to the control line 36.

Figure 14:
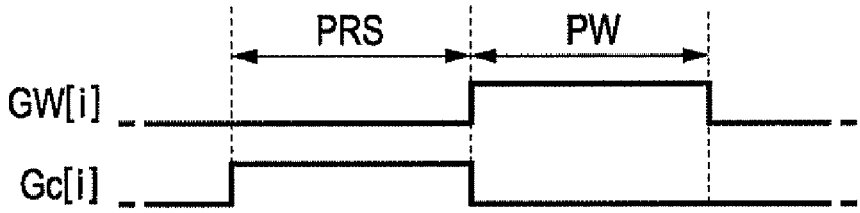
FIG. 14 is a timing chart showing an operation of the electro-optical device.

FIG. 14 is a timing chart showing an operation of the pixel circuit P. As shown in FIG. 14, the control signal Gc[i] supplied to the control line 36 is set to a high level during the initialization period PRS before the start of the writing period PW at which the scanning signal GW[i] of the scanning line 31 becomes a high level. The control signal Gc[i] is maintained to be a low level during a period except for the initialization period PRS.

Since the transistor TR4 becomes an on state by setting the control signal Gc[i] to a high level during the initialization period PRS, the initialization potential VRS is supplied from the initialization line 60 to the gate of the driving transistor TDR via the transistor TR4. Accordingly, a voltage across opposite ends of the storage capacitor C2 is initialized to be a predetermined value (a difference between the potential VEL and the initialization potential VRS) during the initialization period PRS. Meanwhile, since the selection transistor TSL becomes an on state by setting the scanning signal GW[i] to a high level during the writing period PW, the gray-scale potential VD[j] is supplied from the signal line 40 to the gate of the driving transistor TDR. The gate potential VG of the driving transistor TDR is maintained by the storage capacitor C2 even after the writing period PW. Accordingly, the driving current IDR having a current amount in accordance with the gray-scale potential VD[j] is supplied to the electro-optical element E.

Figure 15:
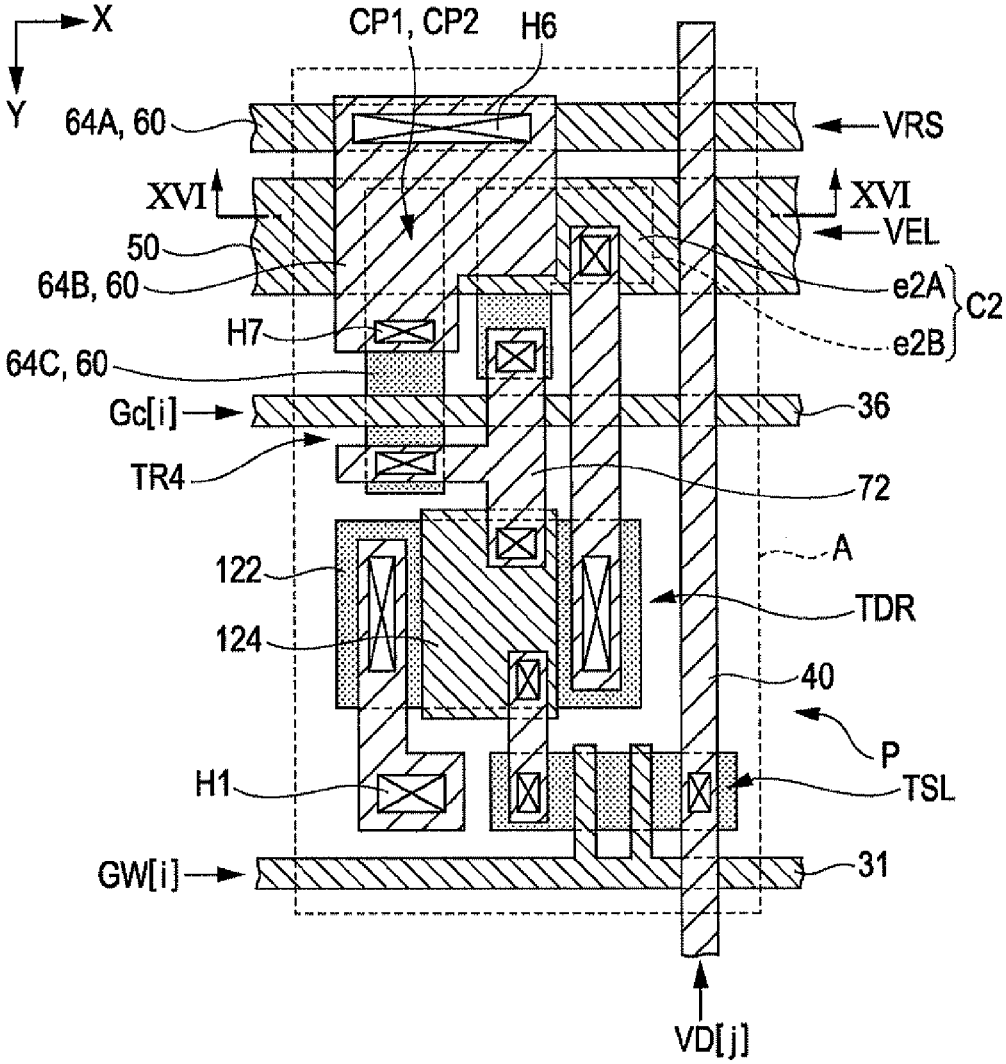
FIG. 15 is a top view showing the pixel circuit.
Figure 16:
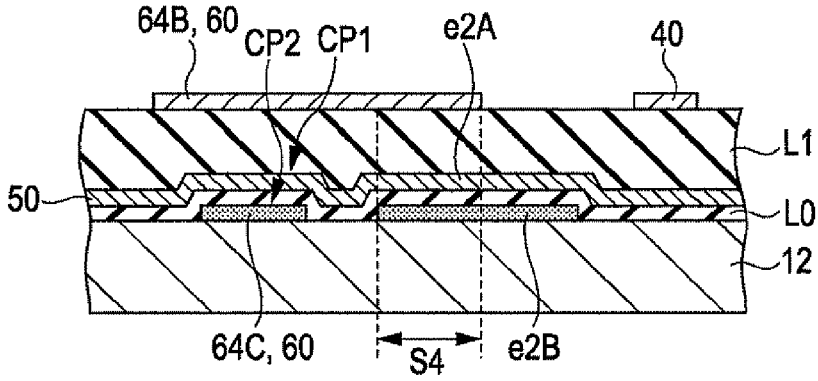
FIG. 16 is a sectional view taken along the line XVI-XVI in FIG. 15.

FIG. 15 is a top view showing the pixel circuit P. FIG. 16 is a sectional view taken along the line XVI-XVI in FIG. 15. As shown in FIG. 15, the power feeding line 50 extends in the X direction and the driving transistor TDR is disposed in the unit area A. The power feeding line 50 is formed of the same layer as those of the gate electrodes 124 and the driving transistor TDR. The scanning line 31 is disposed in the area on the opposite side of the power feeding line 50 with the driving transistor TDR interposed therebetween so as to extend in the X direction. The selection transistor TSL is disposed between the driving transistor TDR and the scanning line 31. In addition, the transistor TR4 and the control line 36 are formed between the driving transistor TDR and the power feeding line 50. The connection relationship between the respective parts of the pixel circuit P has already been described with reference to FIG. 13.

The initialization line 60 includes portions 64A, 64B, and 64C. The portion 64A is formed of the same layer as those of the gate electrodes 124 of the driving transistor TDR (the portion 64A is formed of the same layer as that of the power feeding line 50), and the portion 643 is formed of the same layer as those of the interconnection layers 126 of the driving transistor TDR. The portion 64A is disposed in the area on the opposite side of the driving transistor TDR with the power feeding line 50 interposed therebetween so as to extend in the X direction (a direction parallel to the power feeding line 50). The portion 64C is a portion which is continuous to the semiconductor layer of the transistor TR4. Accordingly, the portion 64C is formed of the same layer as that of the semiconductor layer 122 of the driving transistor TDR. As shown in FIG. 15, the portion 64B is electrically connected to the portion 64A via a connection hole H6 which penetrates the insulating layer L1. Also, the portion 64B is electrically connected to the portion 64C via a connection hole H7 which penetrates the insulating layer L1 and the gate insulating layer L0.

The portion 64B branches in the Y direction from the portion 64A extending in the X direction so as to be continuous to the transistor TR4 (source). Accordingly, as shown in FIGS. 15 and 16, the portion 64B overlaps with the power feeding line 50 with the insulating layer L1 interposed therebetween. In addition, the portion 64C overlaps with the power feeding line 50 with the gate insulating layer L0 interposed therebetween. That is, the power feeding line 50 is interposed between the portions 64B and 64C of the initialization line 60. Accordingly, as shown in FIG. 16, the insulating layer L1 as the dielectric substance is disposed between the power feeding line 50 and the portion 64B of the initialization line 60 so as to form the capacitor CP1. The gate insulating layer L0 as the dielectric substance is disposed between the power feeding line 50 and the portion 64C of the initialization line 60 so as to form the capacitor CP2. The capacitors CP1 and CP2 are arranged in parallel between the initialization line 60 and the power feeding line 50. Accordingly, it is possible to effectively suppress a variation in a potential of the initialization line 60 or the power feeding line 50. Additionally, in the same manner as the third embodiment, it is advantageous in that a capacitance value sufficient for the capacitor CP2 is ensured by using the gate insulating layer L0 thinner than the insulating layer L1 as the dielectric substance.

As shown in FIGS. 15 and 16, the storage capacitor C2 is formed by the electrodes e2A and e2B. The electrode e2B is formed of the same layer as that of the semiconductor layer 122 of the driving transistor TDR, and is electrically connected to the gate electrode 124 of the driving transistor TDR via a wiring 72. The electrode e2A is a portion of the power feeding line 50 which overlaps with the electrode e2B when viewed in a direction perpendicular to the substrate 12 (whereby the electrode e2A is formed of the same layer as that of the gate electrode 124 of the driving transistor TDR).

As shown in FIGS. 15 and 16, the portion 64B of the initialization line 60 overlaps with the electrode e2B of the storage capacitor C2 when viewed in a direction perpendicular to the substrate 12. The power feeding line 50 (the electrode e2A) is interposed between the initialization line 60 and the electrode e2B so as to overlap with an entire area S4 where a part of the electrode e2B overlaps with the initialization line 60. In the above-described configuration, the power feeding line 50 (the electrode e2A) serves as a shield for reducing an influence in which a variation in the initialization potential VRS of the initialization line 60 affects a potential (the gate potential VG) of the electrode e2B. Accordingly, in the same manner as the first to fourth embodiments, it is advantageous in that the pixel circuit P decreases in size by overlapping the storage capacitor C2 with the initialization line 60 and the gate potential VG of the driving transistor TDR is accurately controlled.

F: Modified Examples

The respective embodiments described above are modified into various forms. Hereinafter, the detailed modified examples of the respective embodiments will be described. In addition, in the examples described later, two types or more may be arbitrarily selected to be used in combination.

(1) Modified Example 1

The configuration of the pixel circuit P is not limited to the above-described example. In the invention, it is desirable to adopt the pixel circuit P including the driving transistor TDR which controls the gray scale of the electro-optical element E in accordance with a voltage of the storage capacitor (the storage capacitors C0 to C2 shown in FIG. 2 or the storage capacitor C2 shown in FIG. 11) and the initializer (for example, the transistors TR1 to TR4) which initializes a voltage across opposite ends of the storage capacitor by electrically connecting the initialization line 60 to the storage capacitor. The detailed configurations of the other parts may be arbitrarily set.

(2) Modified Example 2

In the above-described embodiments, the initialization line 60 or the power feeding line 50 are formed of the same layer as that the part of the transistor (for example, the driving transistor TDR) in the pixel circuit P. However, the initialization line 60 or the power feeding line 50 may be formed by a process separate from a process of forming the transistor. Here, according to the configuration in which the initialization line 60 or the power feeding line 50 is formed of the same layer as that of the part of the transistor in the pixel circuit P, it is advantageous in that a process of forming the pixel circuit P is simplified.

(3) Modified Example 3

In the second embodiment (FIG. 8), the configuration in which the storage capacitor C1, the storage capacitor C2, the electrode e0C, and the electrode e0D overlap with the initialization line 60 is exemplified. However, a configuration in which the storage capacitor C1 or C2 does not overlap with the initialization line 60 (a configuration in which the electrodes e0C and e0D overlap with the initialization line 60) may be adopted.

(4) Modified Example 4

The organic EL element is just an example of the electro-optical element E. For example, in the same manner as the above-described embodiments, the invention may be applied to the electro-optical device having an electro-optical element such as an inorganic EL element or an LED (light emitting diode) element disposed thereon. The electro-optical element according to the invention is an element of which a gray scale (brightness) changes in accordance with a current amount of the driving current IDR.

G: Application Example

Figure 17:
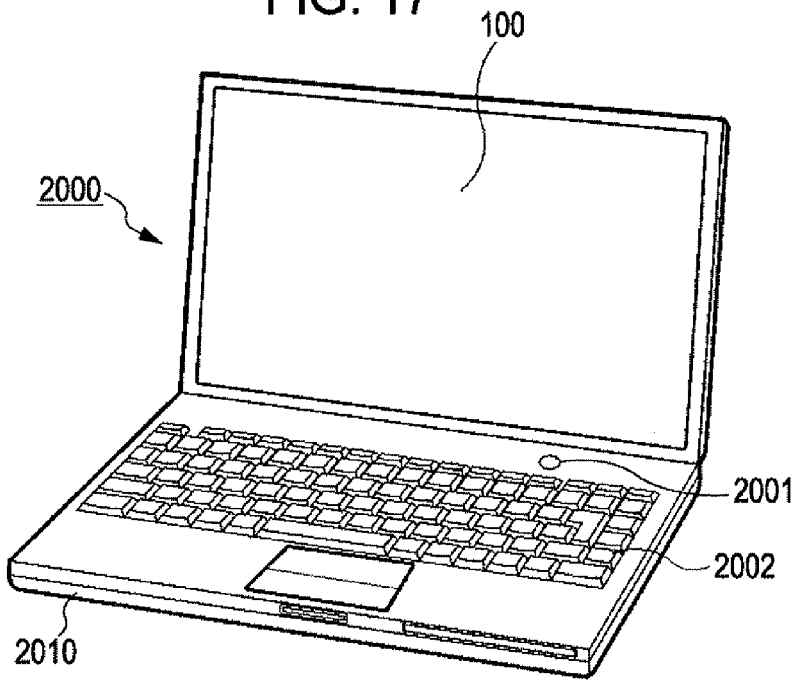
FIG. 17 is a perspective view showing an electronic apparatus (personal computer).
Figure 18:
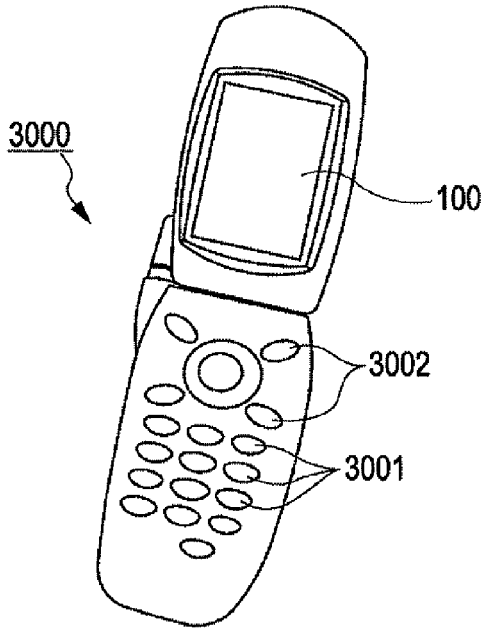
FIG. 18 is a perspective view showing an electronic apparatus (cellular phone).
Figure 19:
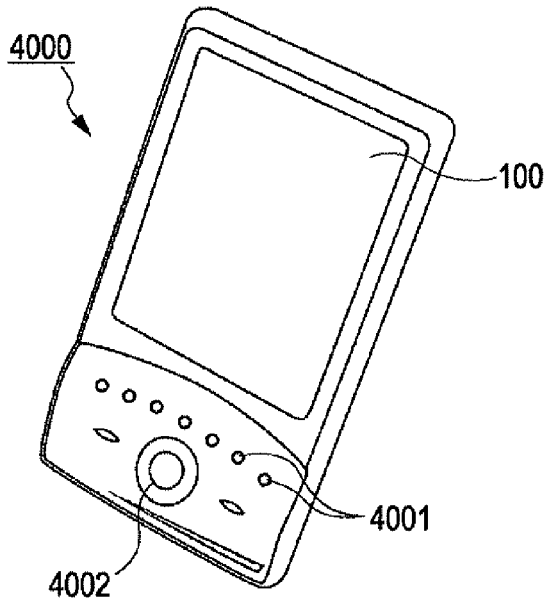
FIG. 19 is a perspective view showing an electronic apparatus (portable information terminal).

Next, an electronic apparatus adopting the electro-optical device 100 according to the above-described embodiments will be described. In FIGS. 17 to 19, the types of the electronic apparatuses adopting the electro-optical device 100 as the display device are shown.

FIG. 17 is a perspective view showing a configuration of a mobile personal computer adopting the electro-optical device 100. A personal computer 2000 includes the electro-optical device 100 which displays various images thereon and a body part 2010 which is provided with a power switch 2001 or a keyboard 2002. Since the electro-optical device 100 adopts the organic EL element as the electro-optical element E, it is possible to display an easily viewed screen having a wide FOV.

FIG. 18 is a perspective view showing a configuration of a cellular phone adopting the electro-optical device 100. A cellular phone 3000 includes a plurality of manipulation buttons 3001, a plurality of scroll buttons 3002, and the electro-optical device 100 which displays various images thereon. By means of the manipulation of the scroll buttons 3002, a screen displayed on the electro-optical device 100 is scrolled.

FIG. 19 is a perspective view showing a configuration of an information portable terminal (PDA: personal digital assistants) adopting the electro-optical device 100. An information portable terminal 4000 includes a plurality of manipulation buttons 4001, a power switch 4002, and the electro-optical device 100 which displays various images thereon. When the power switch 4002 is manipulated, information such as an address book or a schedule book is displayed on the electro-optical device 100.

An example of the electronic apparatus adopting the electro-optical device according to the invention includes a digital camera, a television, a video camera, a car navigation device, a pager, an electronic scheduler, an electronic paper, a calculator, a word processor, a workstation, a videophone, a POS terminal, a printer, a scanner, a copy machine, a video player, or an apparatus provided with a touch panel in addition to the exemplary apparatuses shown in FIGS. 17 to 19. In addition, the application of the electro-optical device according to the invention is not limited to the display of the image. For example, the electro-optical device may be used as an exposure device of an electrophotographic image forming apparatus, the exposure device being used to form a latent image on a photosensitive drum by means of exposure.

The entire disclosure of Japanese Patent Application No. 2008-178122, filed Jul. 9, 2008 is expressly incorporated by reference herein.

What is claimed is:

1. An electro-optical device comprising:

a plurality of pixel circuits, each of which is disposed at a position corresponding to each intersection position between a plurality of scanning lines and signal lines;

a power feeding line; and an initialization line which supplies an initialization potential to the plurality of pixel circuits, wherein each of the plurality of pixel circuits includes:

an electro-optical element which has a gray scale in accordance with a driving current;

a storage capacitor of which a voltage across opposite ends is set in accordance with a potential of the signal line;

an initializer which initializes the voltage across opposite ends of the storage capacitor by electrically connecting the initialization line to the storage capacitor;

a driving transistor which controls the driving current in accordance with the voltage of the storage capacitor, the driving transistor being electrically connected between the power feeding line and the electro-optical element;

a first conductor which is electrically connected to a gate of the driving transistor and overlaps with the initialization line; and a second conductor which is electrically connected to the power feeding line, the second conductor being interposed between the first conductor and the initialization line.

2. The electro-optical device according to claim 1, wherein the driving transistor includes a semiconductor layer, a gate electrode which faces the semiconductor layer with a gate insulating layer interposed therebetween, and an interconnection layer which is formed on a surface of an insulating layer covering the gate electrode so as to be electrically connected to the semiconductor layer, wherein the initialization line is formed of the same layer as that of the interconnection layer, wherein the first conductor is formed of the same layer as that of the semiconductor layer, and wherein the second conductor is formed of the same layer as that of the gate electrode.

3. The electro-optical device according to claim 1, wherein the second conductor includes the power feeding line.

4. The electro-optical device according to claim 1, wherein the storage capacitor includes a first electrode to which a gray-scale potential is supplied from the signal line and a second electrode which is connected to the gate of the driving transistor, and wherein the second conductor includes a portion which is electrically connected to the first electrode.

5. The electro-optical device according to claim 1, wherein the second conductor overlaps with the initialization line at a portion except for a portion overlapping with the first conductor.

6. An electronic apparatus comprising:

the electro-optical device according to claim 1.

* * * * *